United States Patent [19]

Bürge

[11] Patent Number: 5,022,644

[45] Date of Patent: Jun. 11, 1991

[54] METHOD AND APPARATUS FOR FORMING AN IMBRICATED FORMATION OF PRINTED PRODUCTS ARRIVING IN AN IMBRICATED STREAM

[75] Inventor: Norbert Bürge, Wald, Switzerland

[73] Assignee: Ferag AG, Hinwil, Switzerland

[21] Appl. No.: 345,306

[22] Filed: Jan. 12, 1989

[30] Foreign Application Priority Data

Jan. 13, 1988 [CH] Switzerland ..... 102/88

[51] Int. Cl.[5] ..... B65H 5/34

[52] U.S. Cl. ..... 271/270; 271/202; 271/216; 271/265; 198/460

[58] Field of Search ..... 271/150, 151, 202, 203, 271/216, 237, 258, 259, 265, 270; 242/59; 198/460

[56] References Cited

U.S. PATENT DOCUMENTS

| | | | |
|---|---|---|---|
| 3,485,339 | 12/1969 | Miller et al. | 198/460 X |
| 3,714,393 | 1/1973 | Johnson et al. . | |
| 3,719,267 | 3/1973 | Reist et al. | 271/202 X |
| 3,981,493 | 9/1976 | Klappenecker et al. | 271/259 X |
| 4,029,198 | 6/1977 | Lingl, Jr. | 198/460 X |
| 4,139,765 | 2/1979 | Pomey . | |
| 4,296,314 | 10/1981 | Dabisch et al. . | |
| 4,355,712 | 10/1982 | Bruno | 198/460 |
| 4,436,302 | 3/1984 | Frye et al. | 271/216 X |
| 4,577,746 | 3/1986 | Tokuno et al. | 271/202 X |
| 4,750,732 | 6/1988 | Hara et al. | 271/258 |

FOREIGN PATENT DOCUMENTS

| | | | |
|---|---|---|---|
| 1225107 | 8/1987 | Canada | 270/39 |
| 0054735 | 9/1982 | European Pat. Off. . | |
| 2408180 | 6/1979 | France . | |
| 1321934 | 7/1973 | United Kingdom . | |
| 1416105 | 12/1975 | United Kingdom . | |
| 1473721 | 5/1977 | United Kingdom . | |

*Primary Examiner*—H. Grant Skaggs
*Assistant Examiner*—Tuan N. Nguyen
*Attorney, Agent, or Firm*—Fleit, Jacobson, Cohn, Price, Holman & Stern

[57] ABSTRACT

The apparatus for forming an imbricated product formation, in which the pitch between successive printed products can be deliberately selected, comprises successively arranged first and second conveyors. A scanning device detects the printed products arriving on the first conveyor at a first imbrication pitch, and delivers for each printed product a signal to a measuring unit. This measuring unit determines a time dependent value, such as the repetition frequency of the signals produced by the scanning device and delivers such to an evaluation circuit. In the evaluation circuit the thus determined time dependent value is combined with a signal proportional to the deliberately selected pitch between the products and which deliberately selected pitch is different from the first imbrication pitch, and the resultant signal value is delivered to a motor regulator. This motor regulator compares this resultant signal value with a signal generated by a tachogenerator coupled to a drive motor driving the second conveyor, and reglates the drive motor such that the conveying velocity of the second conveyor is adjusted such that the pitch or spacing between successive printed products corresponds to the deliberately selected pitch or spacing.

17 Claims, 1 Drawing Sheet

METHOD AND APPARATUS FOR FORMING AN IMBRICATED FORMATION OF PRINTED PRODUCTS ARRIVING IN AN IMBRICATED STREAM

CROSS-REFERENCE TO RELATED APPLICATIONS

This application is related to the commonly assigned, copending U.S. application Ser. No. 06/922,257, filed Oct. 23, 1986, and entitled "METHOD AND APPARATUS FOR FORMING MULTI-LAYER COILS FROM SUBSTANTIALLY FLAT, FLEXIBLE PRODUCTS, ESPECIALLY PRINTED PRODUCTS, ARRIVING IN AN IMBRICATED PRODUCT FORMATION", now U.S. Pat. No. 4,793,566, granted Dec. 27, 1988, and the likewise commonly assigned, copending U.S. application Ser. No. 264,789, filed Oct. 31, 1988 and entitled "METHOD AND APPARATUS FOR FORMING MULTI-LAYER COILS FROM SUBSTANTIALLY FLAT, FLEXIBLE PRODUCTS, ESPECIALLY PRINTED PRODUCTS", now U.S. Pat. No. 4,923,136, granted May 8, 1990.

BACKGROUND OF THE INVENTION

The present invention relates to a new and improved method of, and apparatus for, forming an imbricated formation from printed products, such as newspapers, periodicals, magazines or the like and which arrive in an imbricated stream.

Generally speaking, the method for forming an imbricated formation from printed products arriving in an imbricated stream, is of the type wherein by increasing or decreasing the conveying velocity and by accordingly altering the pitch or spacing between successive products the infed imbricated formation is transformed into an outfed imbricated formation having a different imbrication, i.e. pitch or spacing between successive products as compared to the infed imbricated formation.

The apparatus for forming a desired imbricated formation having a predetermined pitch of printed products arriving in an imbricated stream, such as newspapers, periodicals, magazines or the like, is of the type comprising a first conveyor or conveying device for the infeed of the imbricated stream of arriving printed products moving in a predetermined direction, and a second conveyor or conveying device arranged downstream of the first conveyor with respect to the predetermined direction of movement of the imbricated stream of printed products. There are provided a control device for controlling a conveying velocity of the second conveyor as well as drive means for driving the second conveyor at the controlled conveying velocity.

From Swiss Patent No. 657,833 and the corresponding Canadian Patent No. 1,225,107 issued Aug. 4, 1987, with which there are cognate the aforementioned related United States patent and patent application, there is known a method and apparatus for forming multilayer coils or packages from printed products arriving in an imbricated formation or stream. This known apparatus comprises two successively arranged conveyors or conveyor devices, wherein the conveying velocity of the downstream conveyor can be altered in relation to the conveying velocity of the upstream conveyor in order to adjust to a predetermined value the thickness of the imbricated formation which is delivered to the wound package. By means of a tachogenerator, there is measured the conveying velocity of the upstream conveyor and such is delivered to an adjustable control device by means of which the conveying velocity of the downstream conveyor is appropriately adjusted or controlled. After such adjustment, the control device ensures that the relationship or ratio between the conveying velocities of both successively arranged conveyors remains essentially constant. In other words, the pitch in the outfed imbricated formation is increased or decreased relative to the pitch of the infed imbricated formation by an amount ensuring that the outfed imbricated formation has essentially constant thickness. As long as the printed products within the arriving or infed imbricated formation or stream are arranged at a constant successive spacing or pitch there is possible the formation of an outfed imbricated product formation or stream of essentially constant thickness, whereas if there prevails an irregular or non-uniform spacing or pitch between the printed products in the arriving or infed imbricated formation, this irregularity is maintained and not compensated in the outfed imbricated formation.

Furthermore, there is known from the European Published Patent No. 0,054,735, published June 30, 1982, an apparatus for forming wound coils or coiled packages from sacks or workpieces which arrive in imbricated formation. With this apparatus the sacks are delivered by means of two successively arranged conveyors to the package. At the drive shaft of the second conveyor, there is arranged a pulse transmitter which outputs pulses corresponding to the angle of rotation of the drive shaft and delivers such to a counter. The counter adds the number of pulses and is repeatedly reset to null whenever a scanning device at the region of the first conveyor detects a further sack which has been delivered in the infed imbricated formation on the first conveyor. If the counter is not reset before it has reached a predetermined threshold value, then the drive motor of the second conveyor is turned off and only restarted as soon as the scanning device has again detected a sack delivered by means of the first conveyor This apparatus does not have any means to deliberately alter the pitch of the imbricated formation. In fact, the apparatus can only make a correction, if the pitch between two successive products accidentally or occasionally becomes greater than the predetermined pitch value which is set by the predetermined threshold value at the counter of the sack-making machine. Instead of turning off and restarting, the motor can also be run at different speeds in order to correct for irregularities in the pitch of the infed imbricated formation. However, the apparatus is not intended or structured to produce an outfed imbricated formation having a pitch which is different from the pitch of the infed imbricated formation.

SUMMARY OF THE INVENTION

Therefore with the foregoing in mind it is a primary object of the present invention to provide a new and improved method and apparatus for forming an imbricated formation from printed products arriving in an imbricated stream or formation in a manner which does not suffer from the aforementioned drawbacks and shortcomings of the prior art.

Another and more specific object of the present invention relates to a simple method and a relatively uncomplicated apparatus for the formation of an imbricated formation of printed products, such as newspapers, periodicals, magazines or the like, arriving in an imbricated stream or formation, wherein there is formed an outfed imbricated product formation having a substantially constant pitch or spacing between successive printed products and which pitch or spacing is different from and independent of the pitch of the arriving or infed imbricated stream or formation.

Now in order to implement these and still further objects of the invention, which will become more readily apparent as the description proceeds, the method of the present development, among other things, is manifested by the features that, there is infed the imbricated stream of printed products at a first imbrication pitch and the products of the infed imbricated stream are scanned. As a result, there is generated a time dependent signal indicative of the first imbricated pitch in the infed imbricated stream of printed products A desired value of a second imbrication pitch is defined and such desired value is different from the first imbrication pitch of the infed imbricated stream. The aforementioned time dependent value and a signal related to the desired value of the second imbrication pitch are combined and there is thus generated a signal related to a reference conveying velocity value An imbricated formation of printed products is outfed at a controlled conveying velocity and the aforementioned reference conveying velocity value is utilized for controlling the conveying velocity of the outfed imbricated formation of printed products in order to thus obtain the desired value of the second imbrication pitch between successive products in the outfed imbricated formation.

As alluded to above, the invention is not only concerned with the aforementioned method aspects but also pertains to an improved construction of an apparatus for changing the imbrication pitch of an imbricated stream of printed products such as newspapers, periodicals, magazines or the like.

To achieve the aforementioned measures, the inventive apparatus, in its more specific aspects, comprises:

a scanning device arranged at the region of the first conveyor;

said scanning device serving for scanning the printed products of the infed imbricated stream of printed products;

said scanning device generating a time dependent signal indicative of the first imbrication pitch in the infed imbricated stream of printed products;

means for generating a signal related to a desired value of a second imbrication pitch different from said first imbrication pitch;

evaluating means connected to the scanning device and the means for generating the signal related to the desired value of the second imbrication pitch;

said evaluating means evaluating the time dependent signal generated by the scanning device conjointly with the desired value of the second imbrication pitch and thereby producing a signal related to a reference conveying velocity value;

signal generating means connected to the drive means for driving the second conveyor and generating a signal indicative of the conveying velocity of the second conveyor;

a control device for controlling the conveying velocity of the second conveyor;

the control device containing the evaluating means and being connected with the scanning device and the signal generating means; and the control device controlling the drive means for driving the second conveyor at the controlled conveying velocity resulting in the desired value of the second imbrication pitch between successive products in said imbricated formation outfed by the second conveyor.

Solely by virtue of scanning the products and thereby determining the product sequence or first imbrication pitch in the arriving or infed imbricated stream in terms of the time dependent value and by combining such time dependent value with the desired value of the different second imbrication pitch, in order to generate a reference conveying velocity value, it is possible to determine and control the conveying velocity of the second conveyor or conveying device such that the second imbrication pitch or spacing between successive products in the outfed imbricated formation corresponds to the desired value irrespective of the first imbrication pitch of the infed imbricated stream or formation. It is unnecessary to measure the conveying velocity of the first or upstream conveyor and equally unimportant or insignificant is knowledge concerning the first imbrication pitch or spacing between successive products in the infed imbricated stream. The conveying velocity of the second or downstream conveyor is controlled via the time dependent signal indicative of the product sequence or first imbrication pitch in the infed imbricated stream or formation by transforming the time dependent signal into a reference conveying velocity value corresponding to the desired value of the second imbrication pitch, which is then maintained irrespective of the product sequence, i.e. the first imbrication pitch of the products in the infed imbricated stream or formation. In other words, based upon a scanned time dependent value and the desired value of the second imbrication pitch or spacing between successive products in the outfed imbricated formation to be formed, there is determined a reference conveying velocity at which the infed products are further conveyed. By controlling such conveying velocity as a function of the time dependent value there is thus ensured that, in the outfed imbricated formation, the imbrication pitch or spacing between successive products remains substantially constant at the desired value irrespective of the first imbrication pitch in the infed imbricated stream or formation.

According to a preferred exemplary embodiment, there is determined from the scanning operation the repetition frequency of the arriving or inbound products. The reference or set conveying velocity for the second conveyor can be determined by multiplication of such repetition frequency by the desired value of the second imbrication pitch or spacing between successive products. This allows regulation of such conveying velocity in a very simple manner.

A quiet running operation can be achieved in that the repetition frequency is formed by an average or mean value formation derived by scanning in each case a plurality of products in the infed imbricated stream or formation.

Furthermore, the time dependent value which is indicative or representative of the product sequence or repetition in the infed imbricated stream can be determined by scanning a time interval between arriving products. In this case, the reference conveying velocity value can be derived by dividing the desired value of the second imbrication pitch or spacing between successive products in the outfed imbricated formation by the scanned time interval.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the product pitch or spacing regulation apparatus and the related regulation device have been illustrated therein as is needed to enable one skilled in the art to readily understand the underlying principles and concepts of this invention. Turning now specifically to the drawings, there will be described in conjunction therewith an exemplary embodiment of the inventive apparatus or arrangement for carrying out the inventive method of transforming an infed imbricated stream or formation of printed products so as to possess a desired different imbrication pitch or spacing between successive products irrespective of variations in the imbrication pitch or spacing between successive printed products before transformation, i.e. in the infed imbricated stream or formation.

Figure 1:
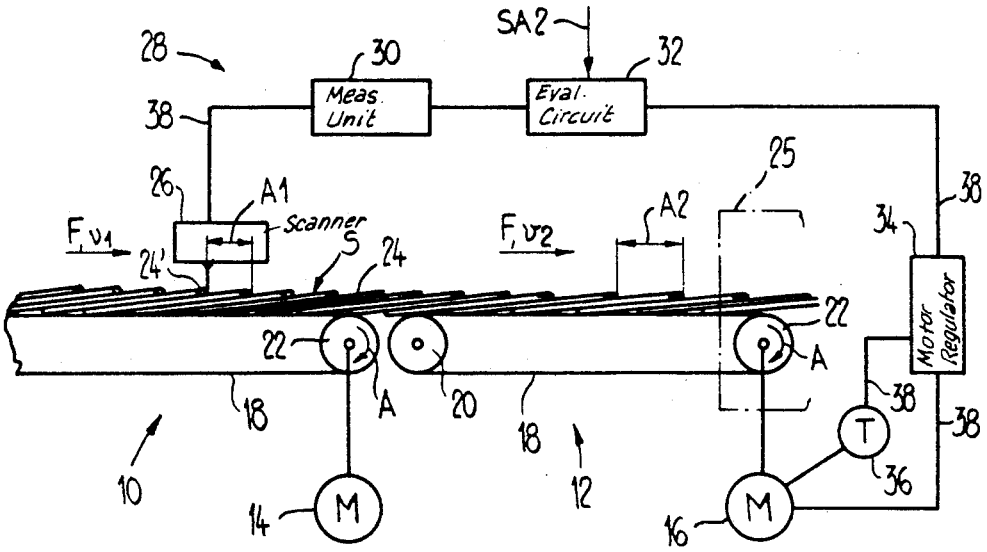
FIG. 1 schematically illustrates an exemplary embodiment of the inventive apparatus or arrangement carrying out the inventive method of forming an imbricated formation in which the imbrication pitch or spacing between successive printed products can be adjusted or regulated to a desired value which is different from the imbrication pitch between successive printed products in an infed imbricated stream of printed products.

As will be readily seen by inspecting FIG. 1, the apparatus comprises a first conveyor or conveyor device 10 and a second conveyor or conveyor device 12 arranged downstream of the first conveyor or conveyor device 10. Both of the conveyors 10 and 12 are constructed as band or belt conveyors and are each driven by means of an associated drive motors 14 and 16, respectively, also schematically indicated by a circle enclosing the letter "M". The drive motors 14 and 16 each rotate in the direction of the associated arrow A. The endless bands or belts 18 of both conveyors 10 and 12 are guided about associated deflection rolls or rollers 20 and 22, it being indicated that as to the first or upstream conveyor 10 there has only been depicted the deflection roll or roller 22 at the end of the conveying-active path of such first conveyor 10.

Continuing, it is further noted that the conveying direction of both conveyors 10 and 12 has been conveniently designated by reference character F, and the conveying velocity of the first conveyor 10 has been designated by reference character v1 and that of the second conveyor 12 by reference character v2. Both of the conveyors 10 and 12 transport or convey printed products 24 which arrive in an infed imbricated stream or formation S. These printed products 24 may be constituted, for instance, by newspapers, periodicals, magazines or the like and are delivered for further processing to a suitable further processing location 25 which has only been schematically shown in chain-dot or phantom lines in FIG. 1. The printed products 24 are arranged in overlapping or shingled formation in the infed imbricated stream S. A first imbrication pitch or spacing between successive printed products 24 in the arriving or infed imbricated stream S has been designated by reference character A1, whereas a different deliberately selectable second imbrication pitch or spacing or pitch between the successive printed products 24 in an outfed imbricated formation at the region of the second conveyor 12 has been designated by reference character A2.

At the region of the first conveyor 10 there is arranged a scanning device or scanner 26. This scanning device 26 or equivalent structure is operatively connected with a subsequently arranged control device or control 28. As best understood by referring to FIG. 2, this control device 28 comprises a measuring unit or device 30, an evaluation means or circuit 32 and a motor regulator 34. A signal generating means conveniently, for example, in the form of a tachogenerator 36, also indicated by reference character T located within a circle in FIG. 1, is operatively connected with the drive motor 16 of the second or downstream conveyor 12 and connected with the motor regulator 34. Electrical connections between the scanning device 26, the control device 28 containing the measuring unit or device 30, the evaluation means or circuit 32 and the motor regulator 34, the signal generating means or tachogenerator 36 and the drive motor 16 have been schematically indicated by the line 38. The arrow pointing towards the evaluation means or circuit 32 in the showing of FIG. 1 and designated by reference character SA2 represents a source for the input of a signal related to the desired, i.e. predetermined or desired value of the second imbrication pitch or spacing A2 which is different from the first imbrication pitch or spacing A1 and exists between successive printed products 24 in the imbricated formation S which is to be formed and outfed. This source has been indicated in FIG. 2 by reference numeral 46 and will be considered more fully shortly.

Figure 2:
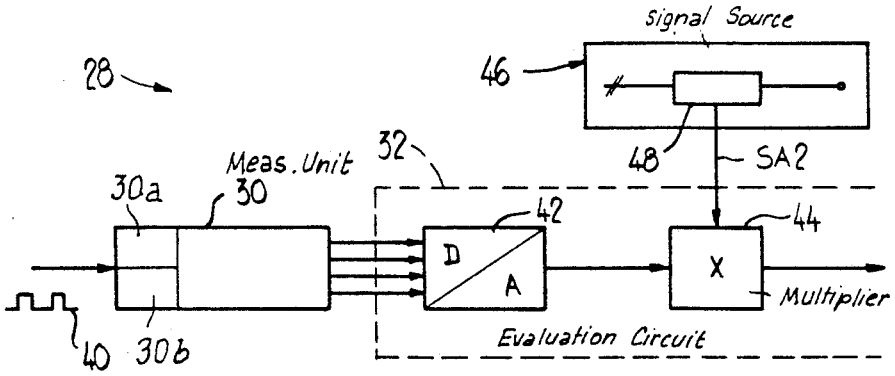
FIG. 2 is a block circuit diagram depicting a portion of the regulation apparatus or device used in the arrangement of FIG. 1.

As already indicated above, in FIG. 2 there has been illustrated a portion of the control device 28 in greater detail. The time dependent signals generated by the scanning device 26 upon detection or recognition of the printed products 24 and delivered to the measuring unit 30 in the form of, for instance, square wave or rectangular pulses have been schematically shown and designated by reference numeral 40. Each square wave pulse corresponds to the leading edge 24' of a printed product 24 in the infed imbricated stream. The measuring unit 30 comprises, for instance, a frequency measuring device, which is generally indicated schematically by reference character **30*a* in FIG. 2 and forms a digital signal proportional to the repetition frequency of the square wave pulses of the signal 40 and delivers such to the evaluation means or circuit 32. The evaluation means or circuit 32 comprises a digital-analog converter 42 which converts the digital signal into an analog signal which is then inputted or delivered to a multiplier or multiplier circuit 44. A generating means or source 46 delivers the signal SA2 which is related to, for example, is proportional to the desired or predetermined different second imbrication pitch or spacing A2, this signal SA2 likewise being delivered to the multiplier 44. The generating means or source 46 comprises, for instance, a schematically depicted voltage divider circuit or voltage divider 48 for generating the signal SA2. The multiplier 44 multiplies the signal produced by the digital-analog converter 42 with the signal SA2 and delivers the result in the form of a signal related to, for example, proportional to the reference or set conveying velocity value of the second or downstream conveyor 12 to the motor regulator or regulator means 34, as also best seen by inspecting FIG. 1. The measuring unit 30 can be additionally equipped with a not particularly illustrated counter or counter unit in order to count the square wave pulses of the signal 40 and thus the number of infed printed products 24**.

Having now had the benefit of the description of the apparatus depicted in FIGS. 1 and 2, its mode of operation will now be considered and is as follows:

The arriving or infed imbricated stream S is delivered in the conveying direction F at the velocity v1 governed by the drive motor 14. The conveying velocity v1 is normally governed by the operating or working velocity of the processing station, for instance a rotary printing machine, which is arranged upstream of the first conveyor 10. As soon as the leading edge 24' of a printed product 24 has passed the scanning device 26 then the latter generates a square wave pulse and delivers such in the form of the signal 40 to the control device 28. The frequency measuring device 30*a* of the measuring unit 30 determines the repetition frequency or rate of the square wave pulses of the signal 40 which constitutes a measure of the printed products 24 which are infed per unit of time, i.e indicative of the first imbrication pitch of the infed imbricated stream of printed products 24. In the multiplier 44 the signal which is proportional to such repetition frequency is multiplied by the signal SA2 which is proportional to the predetermined or desired second imbrication pitch or spacing A2 which exists in the outfed imbricated formation and is different from the first imbrication pitch of the infed imbricated stream. The product of such multiplication operation is delivered to the motor regulator 34 as a signal which is proportional to the reference conveying velocity value of the second or downstream conveyor 12. The motor regulator 34 compares this signal with the signal generated by the tachogenerator 36 which is proportional to the actual conveying velocity v2 of the second or downstream conveyor 12 and, in effect, constitutes a feedback signal, and appropriately controls the drive motor 16 depending upon the comparison result. Thus, from the repetition frequency of the arriving printed products 24 there is determined directly, i.e. by multiplication with the predetermined or desired second imbrication pitch or spacing A2, the reference conveying velocity value v2 for regulating the conveying velocity v2 of the second or downstream conveyor 12.

If the spacing between successive printed products 24 of the arriving or infed imbricated stream S would have to remain unchanged, then both conveyors 10 and 12 would have to be driven at the same conveying velocity v1 and v2. On the other hand and contrary thereto, as illustrated in FIG. 1, when the first imbrication pitch or spacing A1 of the arriving or infed imbricated stream S is intended to be changed to a greater predetermined or desired second imbrication pitch or spacing A2 in the outfed imbrication formation, then the second or downstream conveyor 12 is driven at an increased conveying velocity v2 which is greater than the conveying velocity v1 of the first conveyor 10. The printed products 24 which are located upon the second or downstream conveyor 12 are thus further conveyed at a greater velocity to the further processing location or station 25 than the printed products 24 on the first or upstream conveyor 10. This results in the first imbrication pitch or spacing A1 between successive printed products 24 being deliberately changed to the greater predetermined or desired second imbrication pitch or spacing A2.

On the other hand, when the first imbrication pitch or spacing A1 is to be changed to a smaller predetermined or desired second imbrication pitch or spacing A2, then, in corresponding fashion the second or downstream conveyor 12 is driven at a slower velocity or speed, so that the first imbrication pitch or spacing A1 is deliberately reduced to a smaller predetermined or desired second imbrication pitch or spacing A2 between successive printed products 24.

There is thus formed an outfed imbricated formation S of printed products which, irrespective of the conveying velocity v1 of the first or upstream conveyor 10 and the first imbrication pitch or spacing A1 in the arriving or infed imbricated stream or formation S, possesses a desired intended different, but substantially constant second imbrication pitch or spacing A2 between successive printed products 24.

In the measuring unit or device 30, there also can be determined an average repetition frequency of the arriving printed products 24 arriving in the infed imbricated stream S in that in each case a plurality or multiplicity of square wave pulses of the signal 40 of the scanning device 26 are collectively evaluated. Thus, for instance, there can be determined an average repetition frequency for ten arriving printed products 24. This results in a quieter travel of the second or downstream conveyor 12 since such is subjected to smaller and above all less frequent changes in the conveying velocity v2 due to irregularities of the first imbrication pitch in the infed imbricated stream or formation.

The measuring unit 30 can also possess a suitable time measuring unit, as generally indicated by reference character 30*b* in FIG. 2, which measures the time interval or interpause between two or more successive pulses of the signal 40 generated by the scanning device 26. In this case, the evaluation means or circuit 32 is constructed in such a fashion that it can divide the signal SA2 which is proportional to the predetermined or desired different second imbrication pitch or spacing A2 by this determined time interval. The result of this division operation is proportional to the reference value of the conveying velocity v2 of the second or downstream conveyor 12 and is inputted or delivered to the motor regulator 34 which ensures that the drive motor 16 drives the second or downstream conveyor 12 at the conveying velocity v2 corresponding to such reference conveying velocity value.

It is also to be recognized that the control device 28 can be differently constructed than depicted in FIGS. 1 and 2. Thus, it can be designed with purely digital technology, analog technology or in a hybrid analog and digital technology, similar to what has been depicted in FIGS. 1 and 2. However, it is also possible that the control device 28 and also the motor regulator 34 can be designed on the basis of storage programmable controls or microprocessors.

The only relationship between the first or upstream conveyor 10 and the second or downstream conveyor 12 resides in the fact that the scanning device 26 detects the leading or trailing edges 24' of the printed products 24 in the infed imbricated formation and that the signals 40 produced as a result of the scanning operation are transformed into a time dependent value which is then combined with the desired different second imbrication pitch or spacing A2 in the control device 28 such as to generate the related reference value of the conveying speed of the second or downstream conveyor 12. The above described method and the apparatus for carrying out the same as shown by way of example in the drawings, enables the formation of outfed imbricated formations S in which there is substantially maintained between successive printed products 24 the predetermined or desired second imbrication pitch or spacing A2 which is substantially constant but different from with respect to the first imbrication pitch or spacing A1 or the conveying velocity v1 of the infed or arriving imbricated stream S. Thus the second or downstream conveyor 12 is not started by starting the first or upstream conveyor 10 but an automatic start-up of the second or downstream conveyor 12 is readily possible as soon as the scanning device 26 has detected the first printed product 24 of the infed imbricated stream or formation S.

While there are shown and described present preferred embodiments of the invention, it is to be distinctly understood that the invention is not limited thereto, but may be otherwise variously embodied and practiced within the scope of the following claims.

Accordingly, what I claim is:

1. A method of controlling outfeed imbrication pitch between respective products of an imbricated stream of printed products such as newspapers, periodicals, and magazines, comprising the steps of:

infeeding the imbricated stream of printed products at a first infeed imbrication pitch;

scanning the products of the infed imbricated stream of printed products;

said step of scanning said products of the infed imbricated stream entails generating a time dependent signal indicative of the first imbrication pitch in the infed imbricated stream of printed products;

generating a signal related to a desired value of the outfeed imbrication pitch;

combining the time dependent signal and the signal related to the desired value of the outfeed imbrication pitch and thereby generating a signal related to a reference conveying velocity value;

outfeeding an imbricated formation of printed products; and utilizing the signal related to said reference conveying velocity value for controlling the outfeed imbrication pitch by controlling the conveying velocity of the outfed imbricated formation.

2. The method as defined in claim 1, wherein:

said step of generating said time dependent signal indicative of said first imbrication pitch entails determining the repetition frequency of the printed products arriving in said infed imbricated stream of printed products.

3. The method as defined in claim 2, further including the step of:

forming an average value of said repetition frequency by scanning a predetermined number of the printed products arriving in said infed imbricated stream of printed products.

4. The method as defined in claim 3, wherein:

said step of combining said time depending signal and said signal related to the desired value of said outfeed imbrication pitch entails multiplying the average value of said repetition frequency with the signal related to said desired value of the outfeed imbrication pitch between successive products in said outfed imbricated formation.

5. The method as defined in claim 2, wherein said step of combining said time depending signal and said signal related to the desired value of said outfeed imbrication pitch entails multiplying the repetition frequency with the signal related to said desired value of the outfeed imbrication pitch between successive products in said outfed imbricated formation.

6. The method as defined in claim 1, wherein:

said step of generating said time dependent signal indicative of the first imbrication pitch entails determining the time interval between successive printed products in said infed imbricated stream of printed products.

7. The method as defined in claim 6, wherein:

said step of combining said time dependent signal and said signal related to the desired value of said outfeed imbrication pitch entails dividing the signal related to the desired value of the outfeed imbrication pitch between successive printed products in the outfed imbricated formation, by the determined time interval between successive printed products in the infed imbricated formation of printed products.

8. The method as defined in claim 1, further including the steps of:

infeeding the imbricated stream of printed products by means of a first conveyor; and driving a second conveyor arranged downstream of the first conveyor with respect to a predetermined direction of conveyance of the printed products at the reference conveying velocity.

9. The method as defined in claim 1, wherein:

said step of generating the signal related to said desired value of the outfeed imbrication pitch entails generating a signal proportional to the desired value of the outfeed imbrication pitch; and said step of generating said signal related to the reference conveying velocity value entailing the step of generating a signal proportional to the reference conveying velocity value.

10. An apparatus for controlling outfeed imbrication pitch between respective products of an imbricated stream of printed products such as newspapers, periodicals, and magazines, comprising:

a first conveyor for infeeding the imbricated stream of printed products in a predetermined conveying direction and at a first imbrication pitch;

a second conveyor arranged downstream of the first conveyor with respect to said predetermined conveying direction and for outfeeding an imbricated formation of printed products at the outfeed imbrication pitch;

drive means for driving the second conveyor at a controlled conveying velocity;

a scanning device arranged at the region of the first conveyor;

said scanning device serving for scanning the printed products of the infed imbrication stream of printed products;

said scanning device serving for generating a time dependent signal indicative of the first imbrication pitch in said infed imbrication stream of printed products;

means for generating a signal related to a desired value of the outfeed imbrication pitch;

evaluating means connected to said scanning device and said means for generating said signal related to the desired value of said imbrication pitch;

said evaluating means serving for evaluating said time dependent signal generated by said scanning device conjointly with said signal related to the desired value of said outfeed imbrication pitch and thereby producing a signal related to a reference conveying velocity value;

signal generating means connected to said drive means and serving for generating a signal indicative of the conveying velocity of said second conveyor;

a control device for controlling said conveying velocity of the second conveyor;

said control device contained said evaluating means and being connected with said scanning device and said signal generating means; and said control device controlling said drive means for driving said second conveyor at said control conveying velocity resulting in said desired value of said outfeed imbrication pitch between successive printed products in said outfed imbricated formation outfed by said second conveyor.

11. The apparatus as defined in claim 10, wherein:

said control device comprises a frequency measuring device which produces, from said time dependent signal generated by said scanning device, a repetition frequency of the time dependent signals generated by the scanning device.

12. The apparatus as defined in claim 11, wherein:

said frequency measuring device delivering an output signal; and said evaluating means of the control device comprising means for multiplying the output signal of the frequency measuring device with said signal related to the desired value of the outfeed imbrication pitch.

13. The apparatus as defined in claim 12, wherein:

said control device comprises multiplier means connected at an output side of said frequency measuring device;

source means connected with said multiplier for delivering the signal related to the desired value of said outfeed imbrication pitch; and said multiplier means generating said signal related to said reference value of said conveying velocity.

14. An apparatus for controlling outfeed imbrication pitch between respective products of an imbricated stream of printed products such as newspapers, periodicals, and magazines comprising:

a first conveyor for infeeding the imbricated stream of printed products in a predetermined conveying directions and at a first imbrication pitch;

a second conveyor arranged downstream of the first conveyor with respect to said predetermined conveying direction and for outfeeding an imbricated formation of printed products at the outfeed imbrication pitch;

drive means for driving the second conveyor at a controlled conveying velocity;

a scanning device arranged at the region of the first conveyor;

said scanning device serving for scanning the printed products of the infed imbrication stream of printed products;

said scanning device serving for generating a time dependent signal indicative of the first imbrication pitch in said infed imbrication stream of printed products;

means for generating a signal related to a desired value of the outfeed imbrication pitch;

evaluating means connected to said scanning device and said means for generating said signal related to the desired value of said imbrication pitch;

said evaluating means serving for evaluating said time dependent signal generated by said scanning device conjointly with said signal related to the desired value of said outfeed imbrication pitch and thereby producing a signal related to a reference conveying velocity value;

signal generating means connected to said drive means and serving for generating a signal indicative of the conveying velocity of said second conveyor;

a control device for controlling said conveying velocity of the second conveyor;

said control device contained said evaluating means and being connected with said scanning device and said signal generating means; and said control device controlling said drive means for driving said second conveyor at said control conveying velocity resulting in said desired value of said outfeed second imbrication pitch between successive printed products in said outfed imbricating formation outfed by said second conveyor wherein said control device comprises a time measuring device;

said time measuring device measuring time intervals between at east two signals generated by the scanning device; and means for dividing said signal related to the desired value of said outfeed imbrication pitch by the output signal of the time measuring device.

15. The apparatus as defined in claim 10, wherein:

said means for generating said signal related to the desired value of said second imbrication pitch, generating a signal proportional to the desired value of said outfeed imbrication pitch; and said evaluating means producing as said signal related to the reference conveying velocity value, a signal proportional to the reference conveying velocity value.

16. The apparatus as defined in claim 10, wherein:

said drive means include a drive motor for driving the second conveyor; and said control device containing a motor regulator for regulating the rotational speed of the drive motor of said drive means.

17. The apparatus as defined in claim 16, wherein:

said signal generating means comprises a tachogenerator for delivering a signal proportional to the reference conveying velocity of said second conveyor; and said tachogenerator being connected to said motor regulator and said signal delivered by said tachogenerator, constituting a feedback signal received by said motor regulator.

* * * * *